United States Patent [19]

Matsuda

[11] Patent Number: 4,571,201

[45] Date of Patent: Feb. 18, 1986

[54] TOY GUN CONVERTIBLE INTO ROBOTIC-HUMANOID FORM

[75] Inventor: Takashi Matsuda, Tokyo, Japan

[73] Assignee: Takara Co., Ltd., Tokyo, Japan

[21] Appl. No.: 584,531

[22] Filed: Feb. 28, 1984

[30] Foreign Application Priority Data

Jun. 15, 1983 [JP] Japan ..... 58-107553
Jun. 15, 1983 [JP] Japan ..... 58-91513[U]

[51] Int. Cl.[4] ..... A63H 33/04; A63H 3/46; A63H 33/30

[52] U.S. Cl. ..... 446/85; 446/376; 446/473; 446/487; 124/27

[58] Field of Search ..... 446/85, 97, 99, 72, 446/268, 376, 473, 487, 308; 124/27

[56] References Cited

U.S. PATENT DOCUMENTS 3,453,774 7/1966 Breneman et al. ..... 446/353
3,938,277 2/1976 Goldfarb et al. ..... 446/384
3,946,517 3/1976 Goldfarb et al. ..... 446/383
4,103,451 8/1978 Kawada et al. ..... 446/99
4,150,508 4/1979 Ogawa ..... 446/473 X
4,206,564 6/1980 Ogawa ..... 446/99 X
4,391,060 7/1983 Nakane ..... 446/97 X
4,411,097 10/1983 Murakami ..... 446/376

*Primary Examiner*—Mickey Yu
*Attorney, Agent, or Firm*—Price, Gess & Ubell

[57] ABSTRACT

A combination toy hand gun and robot assembly is provided with accessories to provide multiple play options to a child. The toy gun has a handle member, cylinder member, gun barrel member and a trigger assembly. Each of these elements can be relatively movable to change from the simulation of a toy hand gun into a second position of a humanoid robot. The individual component parts of the toy hand gun are permanently but movably connected together to permit the reconfiguration. The accessory silencer, stock and scope assemblies can be attached to the toy hand gun or can be connected to form other toy configurations independent of the toy gun. To accommodate the toy gun configuration, a pellet projection mechanism can be operatively included.

20 Claims, 35 Drawing Figures

FIG. 18
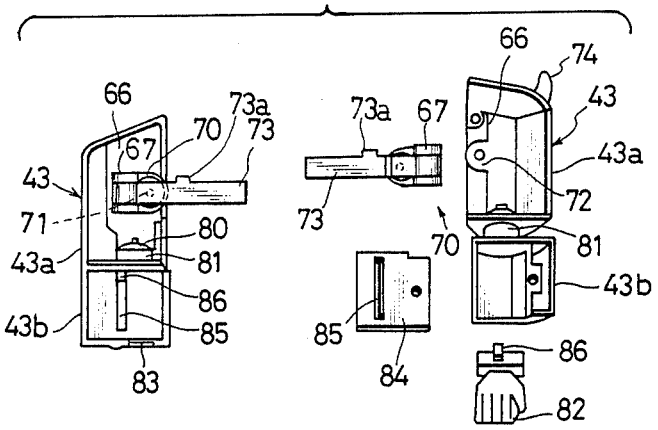
FIG. 19
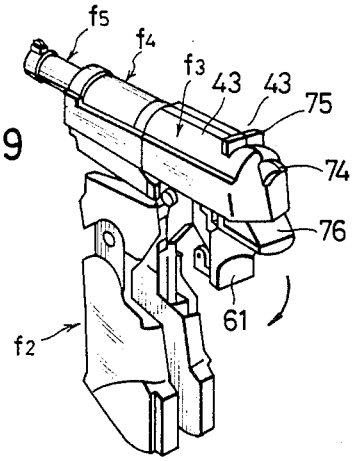
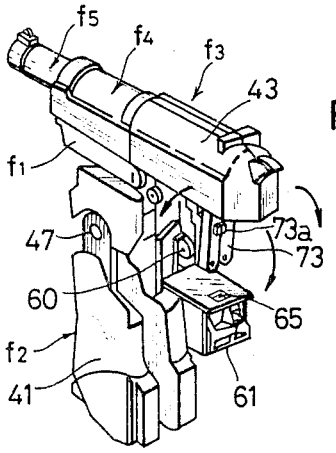
FIG. 20

TOY GUN CONVERTIBLE INTO ROBOTIC-HUMANOID FORM

BACKGROUND OF THE INVENTION

1. Field of the Invention

This invention relates to a reconfigurable toy gun consisting of a gun body and a plurality of accessory parts.

2. Description of the Prior Art

The conventional toy guns include toy guns each of which consists of a gun body and accessory parts. However, in any of these toy guns, the basic form of a gun body cannot be varied by arranging its accessory parts in various manners; only the outer appearances of these toy guns are varied by decorating the toy guns in various manners or extending outer portions thereof in various manners. Accordingly, these toy guns have little variety of form, and do not enable themselves to be played with a gun body and accessory parts combined in various manners.

SUMMARY OF THE INVENTION

An object of the present invention is to provide, in view of the above-mentioned points, a reconfigurable toy gun consisting of a gun body which can be transformed into not only a toy gun but also a toy robotic humanoid, and a plurality of accessory parts which can also be played independently or in a combined state as some other type of toy gun.

Another object of the present invention is to provide a reconfigurable toy gun consisting of a gun body which can be transformed into not only a toy gun but also a toy robotic humanoid, and accessory parts each of which has a connecting portion capable of being joined to connecting portions of both the gun body and the toy robotic humanoid, the accessory parts being able to be played independently or in a combined state as some other type of toy gun, the accessory parts being able to be attached to the toy robotic humanoid as accessory parts thereof.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 18 is an exploded perspective view showing the construction of cover elements;

FIG. 19 is a perspective view taken from the rear side of the embodiment described in FIG. 17;

FIGS. 20–29 are perspective views showing various condition of the toy with its parts displaced linearly and pivotally in various ways;

DETAILED DESCRIPTION OF THE PREFERRED EMBODIMENT

The following description is provided to enable any person skilled in the toy industry to make and use the present invention and sets forth the best modes contemplated by the inventor for carrying out his invention. Various modifications, however, will remain readily apparent to those skilled in the art, since the generic principles of the present invention have been defined herein specifically to provide a novel toy gun.

Figure 2:
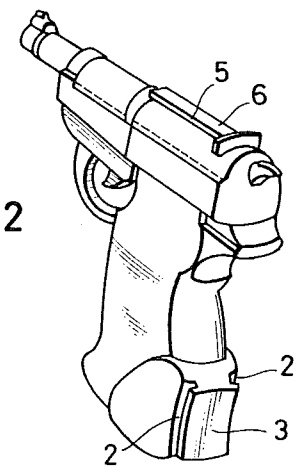
FIG. 2 is a perspective view of the embodiment of FIG. 1 taken from the rear side thereof.
Figure 1:
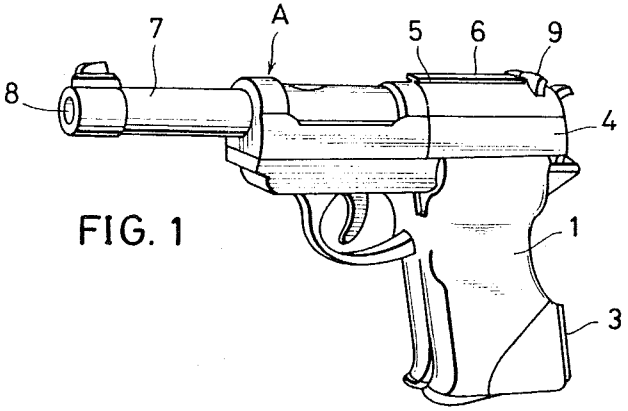
FIG. 1 is a perspective view of an embodiment of a gun body of the present invention.
Figure 3:
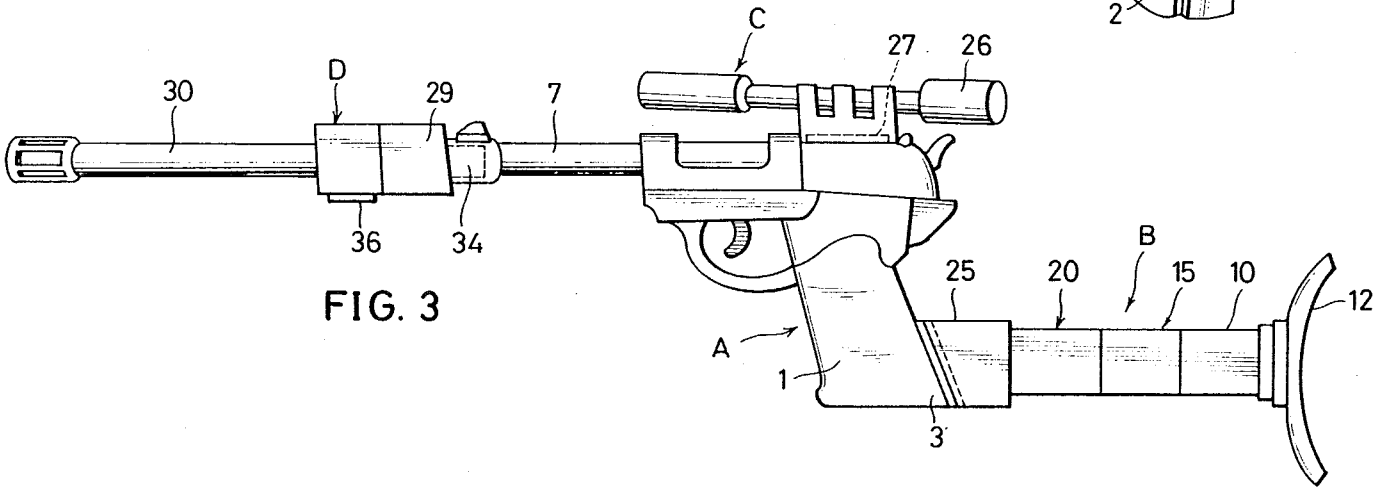
FIG. 3 is a front elevational view of the gun body with accessory parts attached thereto.

Referring to FIGS. 1–3, reference letter A denotes a pistol illustrating an example of use of a gun body of the embodiment. This pistol is formed in the same shape as a regular pistol. In addition, this pistol is provided at a rear end section of a grip 1 with a stock connecting portion 3 having right and left grooves 2, as clearly shown in FIG. 2; on an upper surface of a rear section of a cylinder frame 4 with a scope connecting portion 6 also having right and left grooves 5; and on a barrel 7 with a muzzle 8 as a silencer connecting portion. The grooves 5 in the scope connecting portion are opened at a front end of the cylinder frame but closed at a rear end thereof with a notch 9 of the rearsight provided on the upper surface of the cylinder frame.

The accessory parts provided on the toy gun according to the present invention are a stock B, a scope C and a silencer D as shown in FIG. 3, which illustrates the external appearances of these accessory parts combined with the pistol as examples of the external appearances of parts used as accessory parts of the invention.

These accessory parts will be described with reference to FIGS. 4–11.

Figure 4:
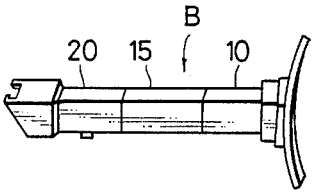
FIG. 4 is a perspective view of a stock.
Figure 5:
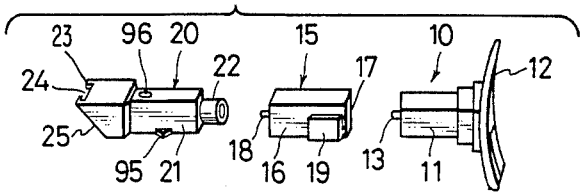
FIG. 5 is an exploded perspective view of the stock.
Figure 6:
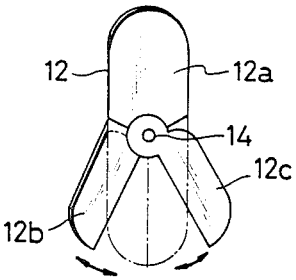
FIG. 6 is a front elevational view of a shoulder covering.
Figure 10:
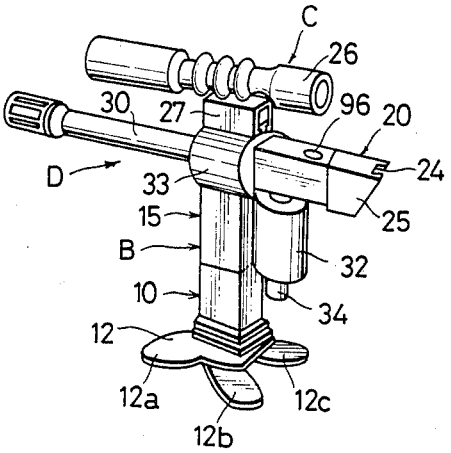
FIGS. 10 and 11 are perspective views of a toy gun consisting of a combination of the stock, scope and silencer.
Figure 11:
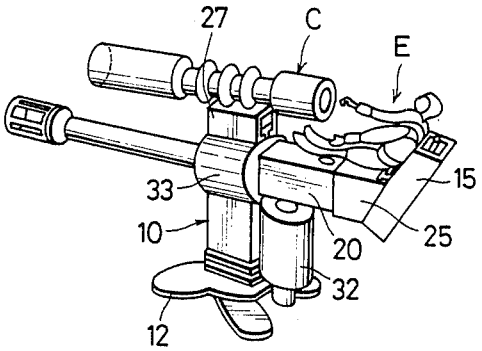

The stock B consists of three members as shown in FIGS. 4 and 5. A first member 10 has a shoulder covering 12 at one end of a shaft 11, and a fitting portion 13, which consists of a projection or a projection-receiving bore, at the other end thereof. The shoulder covering 12 consists, as shown in FIG. 6, of a fixed element 12*a*, and two movable elements 12*b*, 12*c* connected pivotably to the fixed element 12*a* via a shaft 14. When the movable elements are opened, the first member 10 can be set up by placing the shoulder covering 12 on a flat surface as shown in FIGS. 10 and 11.

A second member 15 is provided with a fitting portion 17, which is engageable with the fitting portion 13 of the first member, at one end of a shaft 16, another fitting portion 18 at the other end thereof, and a pair of fitting portions 19, which have recesses opened at right and left ends thereof, on side surfaces of the shaft 16.

A third member 20 has a fitting portion 22, which is engageable with the fitting portion 18 of the second member, at one end of a shaft 21, and another fitting portion 25 at the other end thereof, which fitting portion 25 consists of right and left projections 23 extending diagonally in a vertical plane, and a cross-sectionally C-shaped groove 24 formed between these projections. This fitting portion 25 has such dimensions that enable the stock connecting portion 3 of the pistol to be engaged therewith.

The first, second and third members 10, 15, 20 of the stock B thus formed are joined together as shown in FIG. 4, by engaging the fitting portions 13, 17, 18, 22 with each other. The projections of the fitting portion 25 of the third member are then engaged with the right and left grooves in the stock connecting portion of the pistol. The stock can thus be joined to the grip 1 of the pistol as shown in FIG. 3.

Figure 7:
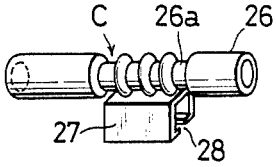
FIG. 7 is a perspective view of a scope.

The scope C has, as shown in FIG. 7, a cylindrical portion 26, and a support 27 connected to a small-diameter part 26*a* of the cylindrical portion 26. The support 27 has at its lower section a pair of projections 28 extending in opposition to each other. The scope can thereby be set on the cylinder frame 4 of the pistol with the two projections 28 engaged with the grooves 5 in the connecting portion of the cylinder frame from a front side thereof. At this time, the notch 9 of the rear-sight works as a stopper. The cylindrical portion 26 is formed at its intermediate part to a smaller diameter, so that the scope looks by itself like a bazooka or a rocket launching cylinder.

Figure 8:
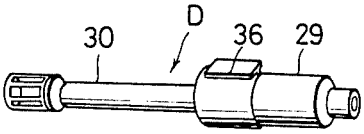
FIG. 8 is a perspective view of a silencer.
Figure 9:
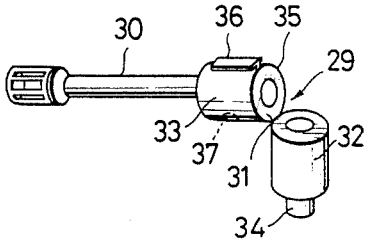
FIG. 9 is a perspective view of the silencer in another state.

The silencer D has a silencing portion 29, and a cylindrical portion 30 extending from the silencing portion, as shown in FIG. 8. The silencing portion 29 consists, as shown in FIG. 9, of two silencing members 32, 33 connected together bendably via a hinge 31, and one silencing member 32 is provided at its free end with a projection 34, which can be inserted into the muzzle 8 of the pistol to be joined thereto. The other silencing member 33 is provided with a bore 35 opened toward the silencing member 32 and capable of receiving the fitting portion 22 of the third member 20 of the stock B. The silencing member 33 is further provided on the section of an outer side surface thereof which is on the opposite side of the hinge 31 with a fitting portion 36 having right and left recesses with which the projections 28 of the support of the scope C can be engaged. A bore 37, with which the projection 18 of the second member 15 of the stock B can be engaged, is also provided in the section of the wall of the silencing member 33 which is on the same side as the hinge 31.

The silencer D thus formed can be connected to the pistol A by inserting the projection 34 into the muzzle 8 at a front end of the barrel thereof with the hinge 31 positioned on the upper side, i.e. with the fitting portion 36 positioned on the lower side as shown in FIG. 3.

Thus, the pistol A shown in FIG. 1 can be transformed into a rifle by combining the stock B, scope C and silencer D therewith.

Owing to the above-described construction of the stock, scope and silencer, when the projection 18 of the second member 15 of the stock is inserted into the bore 37 in the silencing member 33 of the silencer D to be joined thereto with the third member 20 of the stock removed, the projection 22 of the third member 20 of the stock can be fitted into the bore 35 in the silencing member 33 to be joined thereto since the silencing member 32 can be turned downward owing to the hinge 31 as shown in FIG. 9. Since the fitting portion 36 of the silencing member 33 is provided on an upper surface thereof, the support 27 of the scope C can be engaged therewith fixedly. When the movable elements 12*b*, 12*c* of the shoulder covering 12 in the first member of the stock B are opened to be set up as shown in FIG. 10, a toy gun having a gun body consisting of a gun other than a pistol can be formed, which toy gun is provided with a base composed of the shoulder covering 12 and first and second members 10, 15, a machine gun or anti-aircraft gun composed of the silencing member 33 and third member 20, and the scope C.

When the second member 15, which has on its side surface the fitting portion 19 engageable with the groove 24 in the third member 20, in the stock B in the toy gun shown in FIG. 10 is removed therefrom to engage the fitting portion 19 of the second member 15 with the third member as shown in FIG. 11, these two members 15, 20 are connected in the shape of a chair. A toy robot E can then be placed on the members 15, 20 thus connected, to play with this toy with a gun, which consists of the scope C, operated by the robot.

Figure 12:
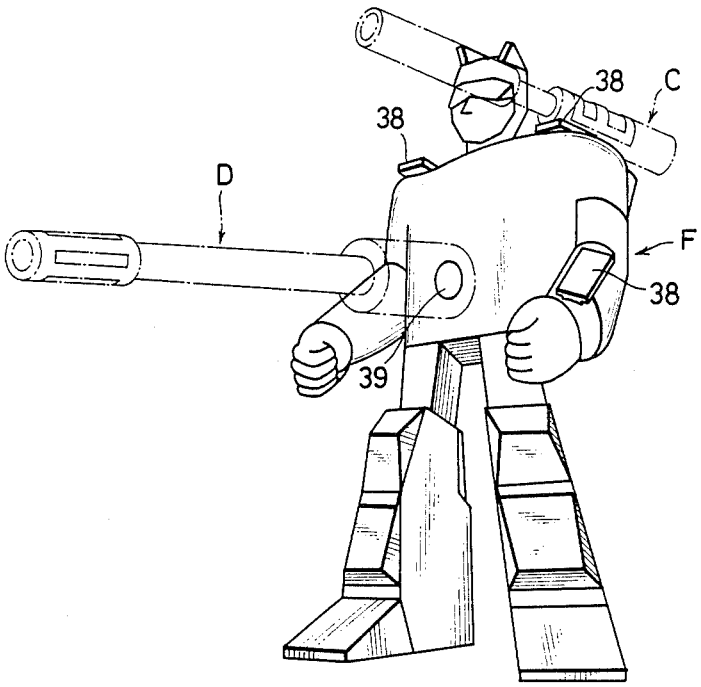
FIG. 12 is a perspective view of an embodiment in which the scope and silencer are used independently of each other.

The scope C and silencer D have support 27, and projection 34 or fitting portion 36 as mentioned above, which can be engaged with a part of some other members of the toy gun. Accordingly, when fitting portions 38 engageable with the support 27 in the scope are provided on, for example, shoulders of a toy robot F, or when a bore 39, into which the projection 34 of the silencer D can be inserted, is provided in the robot, as shown in FIG. 12, the scope C and silencer D can be set on the toy robot F as accessory parts, such as a bazooka, a rocket launching cylinder or a gun including an anti-aircraft gun. The resultant product can be played with as a toy gun the features of which are quite different from those of the toy gun shown in FIG. 3. Reference numeral 38' in FIG. 12 denotes a fitting portion similar to the fitting portions 38. The scope C may be set on the fitting portion 38' with the arm of the toy robot F raised to a horizontal position.

According to the first invention described above, which consists of a gun body and a plurality of accessory parts, the toy gun can be played with by the gun body alone or by a combination of the gun body and accessory parts attached thereto. This combination can be played with as a toy gun the features of which are different from those of the gun body. In addition, the accessory parts can be played with independently or in a combined state as toy guns of different features. Accordingly, the first invention can provide a toy gun capable of being transformed into toy guns of a variety of appearances and features, so that it can foster the associative and creative power of children.

The toy robot F used in the above embodiment is a conventional toy robot having a single form. This invention enables the gun body A to be transformed from the form of a gun into a quite different form of a toy robotic humanoid. Therefore, when the accessory parts of the toy gun are combined with this transformed robotic humanoid, the toy gun can be played with much more variously.

An embodiment of a second invention, in which this concept is realized, will now be described with reference to FIG. 13 and the following.

Figure 13:
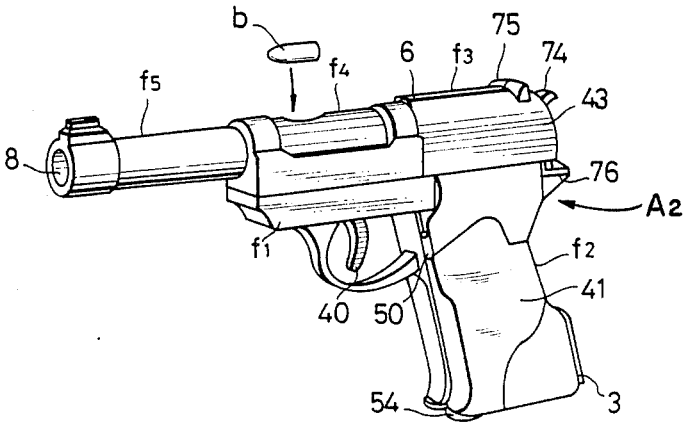
FIG. 13 is a perspective view of a toy gun according to this invention, which is in one mode of use.

FIG. 13 shows a gun body A2 in this invention, which has the form of a pistol. This gun body A2 has a trigger frame or trigger assembly f1 for use in attaching a trigger 40 thereto, a grip or handle member f2 consisting of right and left grip members 41 joined to the trigger frame and a grip frame 42 connected like a crank to the trigger frame f1, a rear cylinder frame f3 consisting of right and left cover members 43 connected pivotably to the grip frame 42, a front cylinder frame f4 fixed pivotably to an upper surface of the trigger frame, and a gun barrel f5 connected bendably to the front cylinder frame. The front cylinder frame f4 and rear cylinder frame f3 form a cylinder assembly to simulate the firing chamber of a gun and its connection to the gun barrel for providing a passageway for a bullet.

In the pistol shown in FIG. 13, a bullet b is loaded on the same, which is in the illustrated state, from an opening made in an upper surface of the front cylinder frame f4, and the trigger 40 is then pressed. Thus, the bullet can be shot from the barrel f5 by a known shooting means provided in the frame f4.

Figure 14:
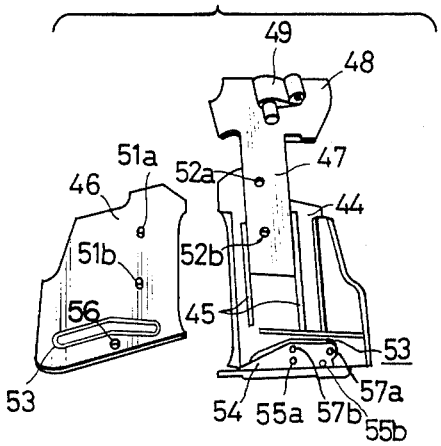
FIG. 14 is an exploded perspective view of a grip.

As shown in FIG. 14, the grip members 41 consist of an outer element 44, an inner element 46 fixed to the outer element as they are spaced from each other by guides 45, which serve also as spacers, and an upper plate 48 having a lower portion 47 inserted among the outer and inner elements 44, 46 and guides 45 the outer element 44 and inner element 46 form the lower leg portion of a humanoid robotic figure while the upper plate 48 forms the upper leg portion of the robot. A hinge 49 is fixed to an inner surface of the upper plate 48 and connected at the other end thereof to a hook and staple 50 pivotably, which is provided in a rear portion of the trigger frame f1. The right and left grip member 41 are formed symmetrically and fixed in the same manner.

Figure 16:
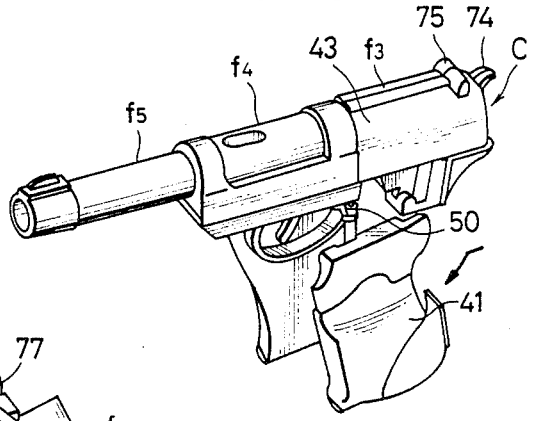
FIG. 16 is a perspective view of the toy gun with grip members displaced outward.

Accordingly, the grip members 41 can be displaced sideways and frontward via the hinge 49 as shown in FIG. 16. When lower portions of the grip members, i.e. the outer and inner elements 44, 46 fixed to each other are drawn downward, projections 51*a*, 51*b* provided on an inner surface of the rear element 46 come into engagement with bores 52*a*, 52*b* provided in an intermediate portion of the upper plate 48, so that the grip members can be retained in a downwardly extended state. The outer element 44 is provided at a lower portion of its inner surface with a guide member 53, in which a foot 54 is slidably recessed. More specifically, the foot 54 is provided on a side surface of its intermediate portion with two guide projections 57*a*, 57*b* to be recessed in the guide member 53, and projections 55*a*, 55*b*, which is engageable with a bore 56 provided on the inner surface of the rear element 46 for maintaining its position when the foot 54 is either extended or kept held in the grip member.

Figure 17:
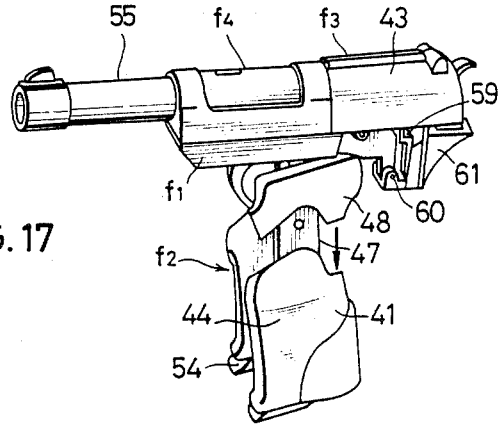
FIG. 17 is a perspective view of the toy gun with its grip extended vertically and with its feed projected outward.

Accordingly, toes can be retained in a downwardly extended state as shown in FIG. 17, or the feet 54 can be kept held on the inner sides of the grip members as shown in FIG. 16.

When the right and left grip members 41 are thus displaced sideways and frontward via the hinge 49, they form legs of a toy robotic humanoid. When the feet 54 are drawn out, these legs can be stood up stably.

The feet 54 are used since it is necessary that the grip members, which are inclined and have horizontal lower end surfaces, and which are to form legs of a toy robot, be stood up perpendicularly. The feet are not required depending upon the shape of the grip members. The grip frame 42, which constitutes the grip f2 with the grip members 41, is formed in the shape of a crank and consists of a middle frame 59 connected at its one end pivotably to a rear end portion of the trigger frame f1 via a hinge 58, and an end frame 61 connected pivotably to the other end portion of the middle frame via a hinge 60. The middle frame 59 is provided with two pins 62, 62 on a rear surface of a lower end section of a vertical portion thereof.

The end frame 61 has a base member 64, which extends from one end of a mounting member 63 at right angles thereto, to the other end of which mounting member 63 the hinge 60 is fixed. The base member 64 is provided on its rear surface with an opening 65 for receiving projections 73*a* of arms 73 described hereinafter. A front surface of the base member 64 is curved so that the grip can be held comfortably, and engraved with a face f of a toy robotic humanoid. When the end frame 61 is turned upward about the hinge 60, the projections 73*a* of the arms 73 are received in the opening 65 for maintaining shape retention in the state where the cover member 43 is forming the cylinder frame f3 as described hereinafter.

The two cover members 43 constituting the rear cylinder frame f3 are formed symmetrically. As shown in FIG. 18, each cover member has in the interior of one side thereof a recess 66, in which a universal joint 70 consisting of connectors 67, and a pin 69 pivotably connecting the connector with one end of the arm 73 is joined by a pin 71 with a fixed member 72 provided on a bottom of the recesses in the cover member, in such a manner that the pin 71 can be moved pivotally. An arm 73 is fixed to the other connector 67. The arm 73 is supported pivotably on a pin 62 provided on the middle frame 59. When the end frame 61 is in an upper position in a path, along which it is pivotally moved, as shown in FIG. 19, the arms 73 in the cover members 43 are held in the opening 65 on the end frame 61 and retained in a vertically extending state.

When the grip members 41 constituting the grip f2 are returned from the state shown in FIG. 17 to the initial state shown in FIG. 13 through the state shown in FIG. 16, the end frame 61 and middle frame 59 are held between the upper end portions of the grip members 41, and the lower end surfaces of the cover members 43 are pressed thereby. Therefore, both of the cover members are retained as if they are combined unitarily with the front cylinder frame f4 with the inner surfaces of the cover members in an abutted state.

Each of the cover members 43 has a hammer portion 74 and a notch portion 75 of the rearsight.

Figure 21:
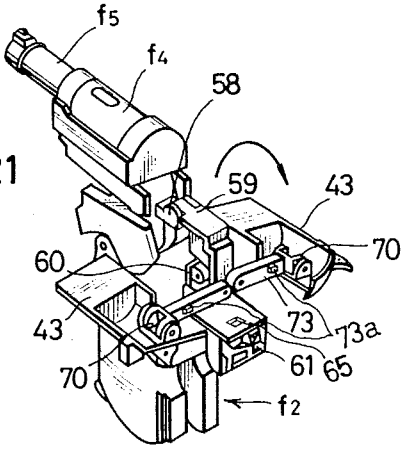

When the end frame 61 shown in FIG. 19 is turned downward as shown in FIG. 20, by pressing a tail portion 76, which projects from a rear end of the rear cylinder frame f3, in the downward direction, the arms 73 are removed from the hold of the opening 65. The cover members 43 can then be turned to right and left as shown in FIG. 21 owing to the universal joints 70 and pins 71. Owing to the employment of the universal joints, the cover members 43 can be turned around the vertical axis with the arms 73 kept horizontal as shown in FIG. 22.

Figure 22:
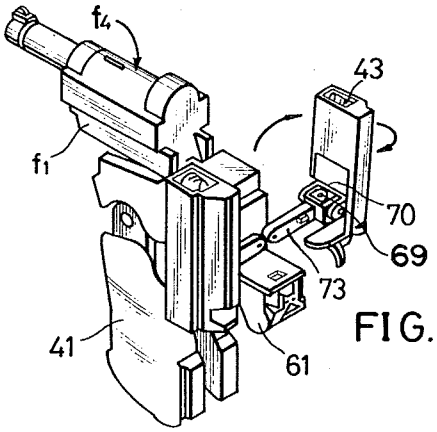
Figure 23:
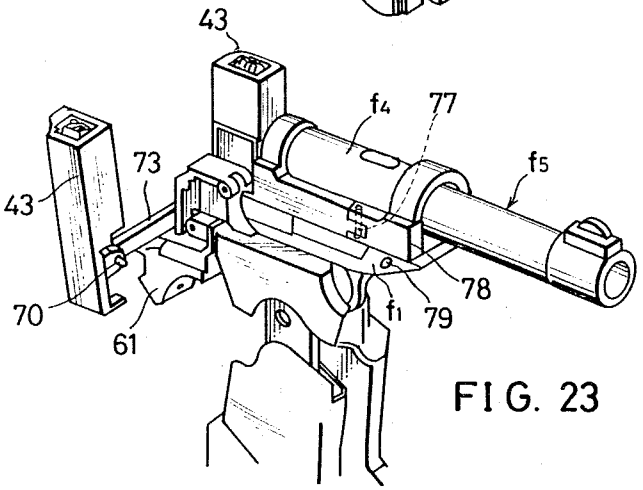

FIG. 23 is perspective view taken from the opposite side of FIG. 22. The front cylinder frame f4 is connected pivotably at its central portion to the trigger frame f1 via a shaft (not shown). The front cylinder frame f4 can be turned with respect to the trigger frame f1 until an angle therebetween reaches 90° as shown in FIG. 24, with the cover members left in pivotally displaced state as described above.

Figure 15:
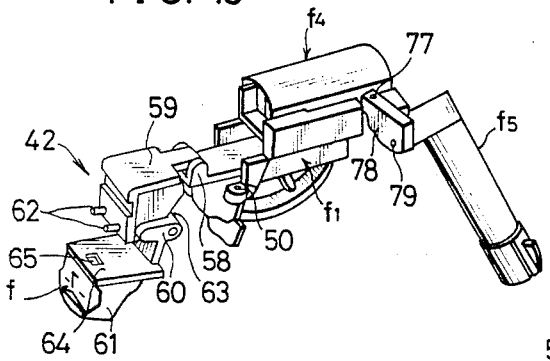
FIG. 15 is a partial perspective view of the toy gun with some component parts removed.

As shown in FIGS. 15 and 23, the front cylinder frame f4 and barrel f5 are connected together bendably via a connecting member 78, which is supported pivotably at one end thereof on the front cylinder frame f4 via a pin 77. The barrel f5 is pivotable at its base end around a horizontal shaft 79. When the barrel f5 is positioned in alignment with the front cylinder frame f4, the base end of the former is fitted in the latter, and the front end of the trigger frame f1 is flush with that of the front cylinder frame f4, which has not yet started being turned. Accordingly, prior to the pivotal movement of the front cylinder frame f4, the base end of the barrel is supported on an upper surface of a front portion of the trigger frame f1, and the front cylinder frame and barrel are supported in an aligned state, as shown in FIG. 23.

Figure 24:
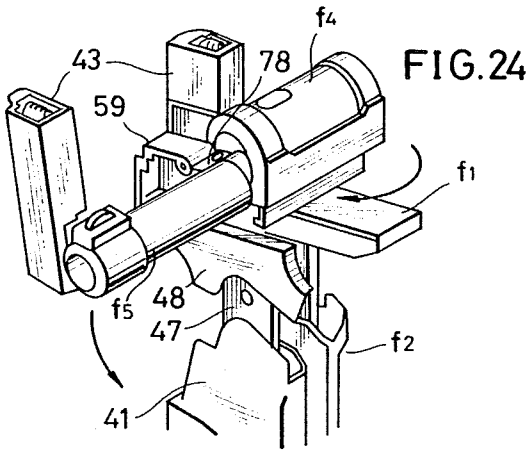
Figure 26:
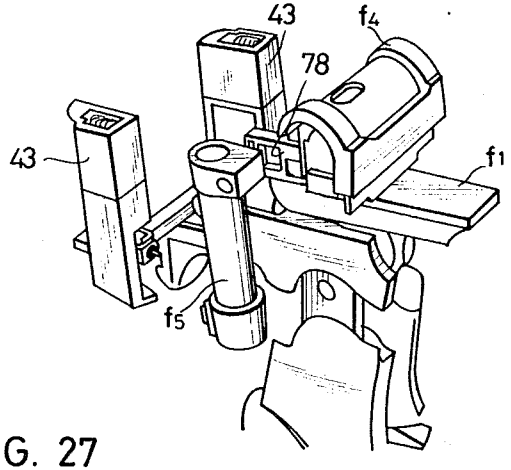
Figure 27:
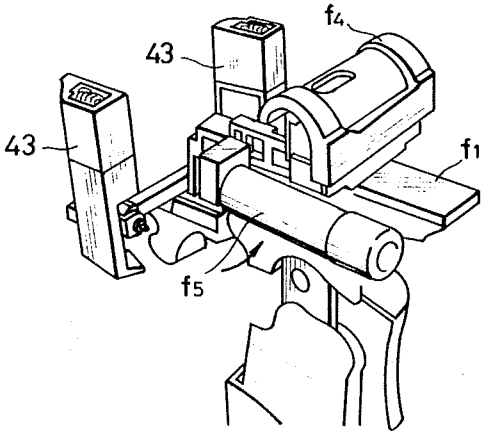
Figure 25:
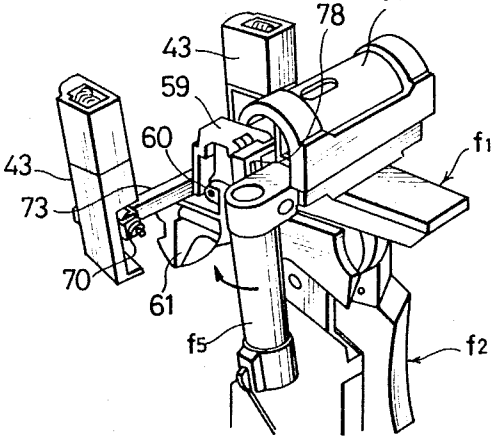

When the front cylinder frame f4 is turned with respect to the trigger frame f1 as shown in FIG. 24, the barrel f5 becomes ready to be turned downward. The barrel f5 is then turned downward as shown in FIG. 25, and thereafter moved backward via the connecting member 78 as shown in FIG. 26. The barrel f5 is then turned around the horizontal shaft 79 until the barrel reaches a horizontal position as shown in FIG. 27, to be fixed due to the friction between the barrel and connecting member.

Figure 28:
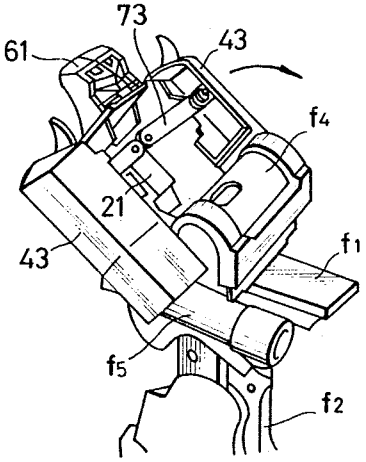

The cover members 43, middle frame 59 and end frame 61, which have been displaced pivotally in previous steps, are then turned up to a position above the front cylinder frame f4 as shown in FIG. 28.

Figure 29:
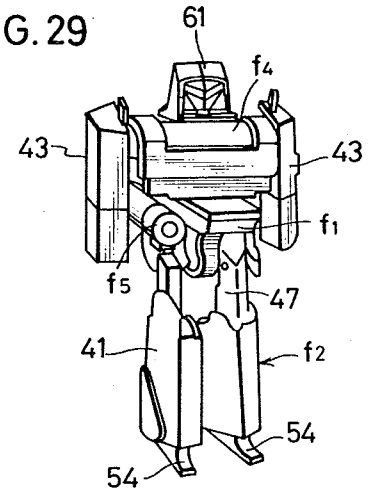

As a result, the two cover members 43, which have constituted the rear cylinder frame f3 of the pistol, turn into arms of a toy robotic humanoid, the front cylinder frame f4 into an upper portion of a body thereof, and the upper surface of the endless frame 61 into the head thereof, as shown in FIG. 29. Namely, the pistol shown in FIG. 13 turns into a toy robotic humanoid having a gun or other type of shooting device f5 held under its arm.

Figure 30:
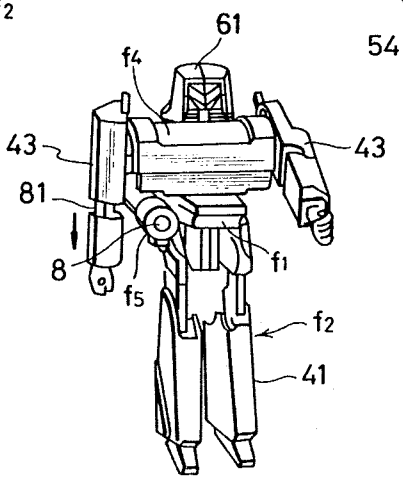
FIGS. 30 and 31 are perspective views of a toy robotic humanoid, which has been transformed from a toy gun.

Each of the cover members 43 consists as shown in FIG. 18 of two cover elements, i.e. a cover element **43*a* provided with the universal joint 70, and a cover element 43*b* joined to the cover element 43*a* via a connector 81 having a stopper 80. The cover members 43*a*, 43*b* can be displaced toward and away from each other via the connecting member 81 as shown in left-hand and right-hand portions of FIG. 18. In a recess in each of the cover elements 43*b*, a hand 82 of a toy robot is housed in such a manner that the hand 82 can be extended and retracted through a bore 83 made in a wall of the cover element 43*b*. When a projection 86 of the hand is moved along a slit 85 made in a lid 84, which is fixed to a rear side of the cover element 43*b*, the hand 82 can be extended out of the cover element 43*b*. Namely, a toy robot with its hands extending out of the arms as shown in FIG. 30 can be obtained. Since the cover members 43 have universal joints 70, the arms of the toy robot can be moved in an arbitrary direction as shown in FIGS. 30 and 31**.

Figure 31:
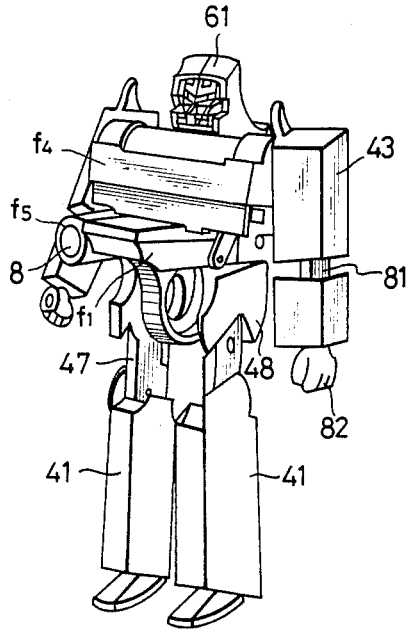

When the order of the above-described operations is reversed, the toy robotic humanoid shown in FIGS. 29–31 can be transformed again into the toy pistol shown in FIG. 13.

Figure 32:
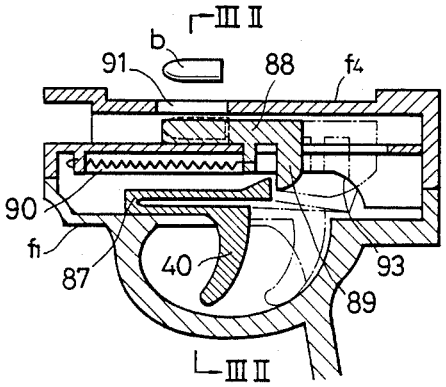
FIG. 32 is a partial sectional view of a shooting device.
Figure 33:
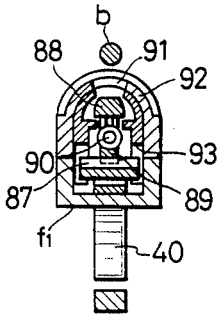
FIG. 33 is a sectional view taken along the line III II—III II in FIG. 32.
Figure 34:
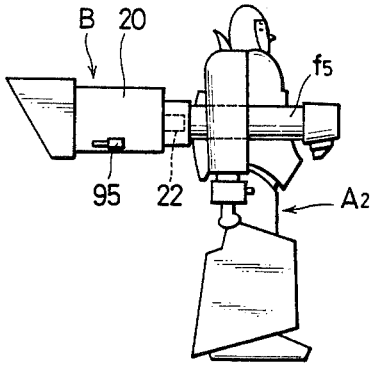
FIGS. 34 and 35 are side elevational views of embodiments of toy robotic humanoid, each of which has a gun body transformed into toy robot and including accessory parts attached thereto.

An example of the shooting device provided in the trigger frame f1 and front cylinder frame f4 will now be described with reference to FIGS. 32 and 33. When the trigger 40 is pressed, a flexible locking portion 87 provided at a front end thereof causes a slider 88 to be moved backward via a hook portion 89 thereof. Consequently, a spring 90 provided between the slider 88 and an inner surface of a front end of the front cylinder frame expands, so that the energy is reserved. When a bullet b is inserted from a bore 91 provided in an upper wall of the front cylinder frame, before the trigger is pressed, the bullet enters the inside thereof a little after the trigger is pressed since the slider is displaced behind the bore 91 immediately before the slider reaches a rear end of its stroke. When the trigger is fully pressed, the locking portion 87 is bent downward due to a taper portion 93 formed on a rear end section of a slider guide 92, to cause the hook portion 89 of the slider 88 to be removed from the locking portion 87. Consequently, the slider 88 is sent forth forcefully owing to the spring 90 to shoot the bullet b.

As described above, the gun body in this invention can be transformed from a toy gun into a toy robotic humanoid. In this toy robotic humanoid, the barrel constituting a connecting element capable of being joined to accessory parts of a gun is opened at its front and rear ends as shown in FIGS. 30 and 31. Accordingly, the fitting portion 22 of the third member 20 of the stock B, an accessory part of a gun, can be engaged with a rear end portion of the barrel, the muzzle of which faces in the forward direction, to be joined thereto. The third member 20 is provided therein with a shooting device, which is similar to that provided in the gun body adapted to be transformed into a toy robotic humanoid. When a projection 95, which functions as a trigger, is operated, a bullet inserted from a bore 96 provided in the third member can be sent forth from the barrel.

Figure 35:
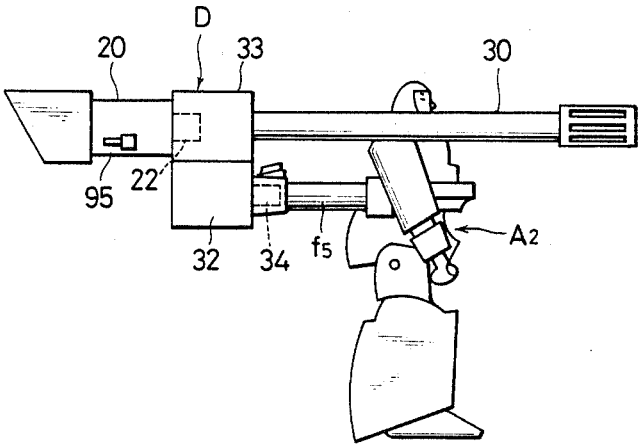

Also, when the projection 34 of the silencer D, one of the accessory parts of a gun, is inserted into the muzzle, which faces in the rearward direction as shown in FIG. 35, of the barrel f5 with the cylindrical portion 30 turned up to direct its front end frontward and with the fitting portion of the third member 20 of the stock engaged with the bore 35 in the silencing member 33 to be fixed therein, a bullet can be sent forth from the third member.

According to the second invention described above, the gun body can be transformed into not only a toy gun but also a toy robot. Since the gun body has connecting portions engageable with accessory parts of a toy gun, such parts can be attached to the gun body, which has been transformed into a toy robot, as accessory toy guns, which are different from the non-accessory toy guns, for a toy robot. Thus, the toy gun according to the invention can be played with in a variety of ways in a variety of forms.

What is claimed is:

1. A combination toy gun and robotic-humanoid assembly that can be reconfigured from a gun configuration to a robot configuration at the option of the user comprising:

a handle member;

a cylinder assembly;

a gun barrel member attached to the cylinder assembly;

a trigger assembly positioned adjacent the handle member and beneath the cylinder assembly, the handle member, cylinder assembly, gun barrel member and trigger assembly being connected together for simulating the configuration of a gun in a first position, and a robot head member movably connected to the trigger assembly, the handle member being configured to simulate the robotic legs of a humanoid robot when moved to a second position, a portion of the cylinder assembly being movable relative to the handle member and configured to simulate the robotic arms of a humanoid robot when moved to a second position, with the robotic head positioned adjacent the robotic arms and above the robotic legs wherein a toy robotic humanoid assembly can be provided in the second position by reconfiguration of the toy gun configuration.

2. The invention of claim 1 wherein the handle member is bifurcated into a pair of leg members.

3. The invention of claim 2 wherein each leg member includes a foot member at its lower surface that can be extended or retracted.

4. The invention of claim 3 wherein each leg member includes an upper and lower leg portion that is relatively slidable to enable a compact handle configuration or an extended robot leg configuration.

5. The invention of claim 4 wherein the upper leg portions are pivotally mounted adjacent the trigger assembly to permit rotation of the leg members.

6. The invention of claim 1 wherein the gun barrel member in pivotally connected to the cylinder assembly.

7. The invention of claim 1 wherein the robotic head is mounted adjacent the cylinder member.

8. The invention of claim 1 wherein the handle member, gun barrel member, cylinder member, and trigger assembly are configured to simulate the physical configuration of a Walther P-38 caliber pistol in the first position.

9. A combination toy hand gun and robotic-humanoid assembly that can be reconfigured from one configuration to another configuration and combined with accessory parts to provide various play configurations for a child, comprising:

a handle member;

a cylinder assembly positioned above the handle member;

a gun barrel member attached to the cylinder assembly;

a trigger assembly positioned adjacent the handle member and beneath the cylinder assembly, the handle member, cylinder assembly, gun barrel member and trigger assembly being pivotally and permanently connected together to permit relative movement so that a configuration simulating a gun is provided in a first position but other configurations are possible, and a robotic head member is movably connected to the trigger assembly, the handle member further is divided into a right and left grip member that can be moved apart from each other and extended away from the trigger assembly to simulate a pair of robotic legs of a humanoid configuration, a portion of the cylinder assembly can be reconfigured by movement to simulate the robotic arms of a humanoid robot whereby the elements forming the physical configuration of a toy gun in a first position can be moved to a second position with the robotic head, arms and legs juxtapositioned relative to the other elements of the toy gun to provide a simulated robotic humanoid assembly.

10. The invention of claim 9 wherein the robotic head member is pivotally connected to the trigger assembly.

11. The invention of claim 10 wherein the robotic head member provides a simulated humanoid face configuration on one side and a curvilinear configuration on the other side to complement the upper portion of the handle member in a gun congiguration.

12. The invention of claim 10 wherein a rear portion of the cylinder assembly is bifurcated into separate cylinder parts and pivotally mounted to extend away from each other to form simulated arm appendages in the second position as a humanoid robot.

13. The invention of claim 12 wherein a simulated humanoid hand is slidably connected to each of the bifurcated parts and can be extended in the second position as a humanoid robot.

14. The invention of claim 13 wherein each of the grip members includes a foot support member movably connected to the lower surface of the grip member so that it can be extendable in a second position as a humanoid robot.

15. The invention of claim 1 wherein a front portion of the cylinder assembly is rotatably connected to the trigger assembly and can be rotated to simulate the upper trunk of a humanoid robot in a second position.

16. The invention of claim 15 wherein the handle member, gun barrel member, cylinder member and trigger assembly are configured to simulate the physical configuration of a Walther P-38 caliber pistol in the first position.

17. The invention of claim 9 further including a simulated silencer assembly, a simulated stock assembly to provide support against a user's shoulder and a simulated scope assembly, each of which can be removably mounted to the toy hand gun configuration.

18. The invention of claim 17 wherein the silencer, stock and scope assemblies have connectors that can be interconnected to form a simulated toy anti-aircraft gun separate from the toy hand gun.

19. A combination toy hand gun and robotic-humanoid assembly that can be reconfigured from one configuration to another configuration and combined with accessory parts to provide various play configurations for a child, comprising:

a handle member;

a cylinder assembly positioned above the handle member;

a gun barrel member attached to the cylinder assembly;

a trigger assembly positioned adjacent the handle member and beneath the cylinder assembly, the handle member, cylinder assembly, gun barrel member and trigger assembly being pivotally and permanently connected together to permit relative movement so that a configuration simulating a gun is provided in a first position but other configurations are possible, and a robotic head member is movably connected to the trigger assembly, the cylinder assembly has a front and rear portion, the front portion is rotatably connected to the trigger assembly and can simulate an upper trunk of a humanoid robot while the rear portion is bifurcated into two separate parts to simulate arm appendages; the handle member further is divided into a right and left grip member that can be moved apart from each other and extended away from the trigger assembly to simulate a pair of robotic legs of a humanoid configuration, whereby the elements forming the physical configuration of a toy gun in a first position can be moved to a second position with the robotic head, trunk, arms and legs juxtapositioned relative to the other elements of the toy gun to provide a simulated robotic humanoid assembly.

20. The invention of claim 19 further including a simulated silencer assembly, a simulated stock assembly to provide support against a user's shoulder and a simulated scope assembly, each of which can be removably mounted to the toy hand gun configuration, the silencer, stock and scope assemblies have respective connectors that can be interconnected to form a simulated toy anti-aircraft gun separate from the toy hand gun.

* * * * *